United States Patent [19]

Duceppe

[11] 4,282,891

[45] Aug. 11, 1981

[54] FINGERNAIL TREATING DEVICE

[75] Inventor: Antoine Duceppe, Ville d'Anjou, Canada

[73] Assignee: Revelations Antoine Ltee, Ville d'Anjou, Canada

[21] Appl. No.: 912,887

[22] Filed: Jun. 5, 1978

[51] Int. Cl.[3] ..... A45D 29/18

[52] U.S. Cl. ..... 132/73.5; 401/122; 132/75

[58] Field of Search ..... 132/75, 73, 81, 73, 132/73.5; 401/122; 15/136, 97 R, 257.05, 210 R, 244; 264/155

[56] References Cited

U.S. PATENT DOCUMENTS

| | | | |
|---|---|---|---|
| 2,436,291 | 2/1948 | Daniel | 15/257.05 |
| 2,596,725 | 5/1952 | Robbins | 15/244 R |
| 2,629,124 | 2/1953 | Merritt | 132/75 |
| 2,673,362 | 3/1954 | Robinson | 15/136 |
| 2,713,693 | 7/1955 | Johnson | 15/210 R |
| 2,722,719 | 11/1955 | Altstadter | 264/155 |
| 2,774,093 | 12/1956 | King | 401/122 |
| 3,316,922 | 5/1967 | Seidler | 401/122 X |
| 3,369,553 | 2/1968 | Keesee | 132/73.5 |
| 3,375,538 | 4/1968 | Mains et al. | 15/210 R |
| 4,117,566 | 10/1978 | Ward | 15/210 R |

*Primary Examiner*—G. E. NcNeill

*Attorney, Agent, or Firm*—Schwartz, Jeffery, Schwaab, Mack, Blumenthal & Koch

[57] ABSTRACT

A device for use in treating fingernails with a liquid, such as a nail polish remover. The device comprises a flat-bottomed, cylindrical container having an open top normally closed by a cover. A cylindrical sponge is press-fitted into the container to be frictionally held in place. A finger hole is provided in the sponge. Treatment liquid is poured into the container to be absorbed by the sponge to a level where it can act on the end of a finger inserted into the hole. The finger fits snugly in the hole and is rotated or oscillated therein to assist the treatment.

8 Claims, 4 Drawing Figures

FINGERNAIL TREATING DEVICE

The present invention relates a device for use in treating finger nails with a liquid.

This invention more particularly relates to a device for use in removing fingernail polish with the aid of a liquid nail polish remover.

Fingernail polish cracks and/or chips in time and, as a result, makes polish-covered nails unsightly in appearance. The old polish must be frequently removed in order to apply fresh polish for a neat appearance. The old polish can be removed "dry", by peeling or stripping it off the nails. However, this is a slow, tedious operation. More commonly, the dried nail polish is softened with a nail polish solvent to make it easier and thus quicker to remove the polish. However, using the solvent can be a messy job since it is usually applied with a brush and can spatter and drip during use.

To avoid the above mentioned drawbacks, devices have been proposed to hold and apply a nail polish removing liquid in a manner which minimizes the usual mess associated in cleaning nails of polish. Similar types of devices have been proposed to hold and apply manicuring liquid to the nails.

One of these devices, associated with manicuring, is shown in U.S. Pat. No. 1,753,044. The device shown in this patent has a container for holding the manicuring liquid. The container has a top with a finger opening designed to tightly receive a finger inserted therethrough into the container. The disadvantages of this type of container are that the finger opening becomes worn and then does not seal properly, and also that the liquid remover can be spilled if the container is tipped over while the cover is off and the container is not in use.

Another of these devices, associated with nail polish removing, is shown in U.S. Pat. No. 2,524,681, and also in U.S. Pat. No. 2,703,422. The device shown in these patents comprise a container for holding a nail polish removing liquid and a fingernail cleaning brush positioned within the container. Again, if the container is tipped, with the cover off, liquid is spilled. In addition, the container and/or cleaning brush are of a somewhat complicated design in order to properly hold and correctly position the brush within the container, thus adding to the cost of the container.

A nail polish removing device somewhat similar to that shown in U.S. Pat. No. 2,524,681, is shown in U.S. Pat. No. 3,316,922. This device however has the same disadvantages as the device shown in U.S. Pat. No. 2,524,681.

A nail polishing device is shown in U.S. Pat. No. 3,369,553 which uses a liquid absorbing member mounted within a container. The member is arranged to provide an aperture for a finger. The device eliminates the need for special brushes. However, special means must be provided to "lock" the absorbing member within the container against rotation. In addition because of its small size, special stand means are required for the container. Further, if the container is tipped while not in use, liquid which accumulates at the rounded bottom end of the container will spill out.

Thus, it appears that all known devices for use in treating the nails of fingers with a liquid have disadvantages.

It is therefore an object of the present invention to provide a nail treating device which eliminates or minimizes the disadvantages of the known devices.

It is another object of the present invention to provide a device for treating fingernails with a liquid, which is extremely simple, and thus relatively inexpensive, in construction.

It is a further object of the present invention to provide a device which is stable to minimize tipping and which minimizes spillage of liquid even if inadvertently tipped.

It is still another object to provide a device with simple means to wipe the finger when it is inserted in the container to contact liquid carried in the container.

In accordance with the present invention, these objects are achieved with a device comprising a cylindrical, flat-bottomed container provided with a removable cover, for holding fingernail treating liquid. The device also comprises a liquid absorbing member consisting of a sponge pad sized to be frictionally held within the container. The pad absorbs the treatment liquid. A blind hole, or similar means, such as a series of slits, are provided in the center of the pad for snugly receiving at least the end of a finger to be treated. The finger receiving means is relatively small in comparison to the size of the container so that the container may be easily handled.

In use, the treating liquid is poured into the container, to be absorbed by the sponge. The liquid level in the sponge must be above the bottom of the hole. The inner surface of the finger receiving hole helps clean the finger when the finger is rotated within the hole in contact with the liquid. Thus no special brushes are needed.

The hole is relatively small compared to the size of the container. Thus the friction fit of the pad within the container serves to hold the pad in place while the finger is rotated in the hole in the pad without requiring special pad holding means.

The sponge pad, holding the liquid, prevents liquid from easily escaping from the container even if the container is inadvertently tipped when open. The pad absorbs the majority of the liquid so that little is left to form a free flowing pool.

The invention will now be described in detail having reference to the accompanying drawings in which.

Figure 1:
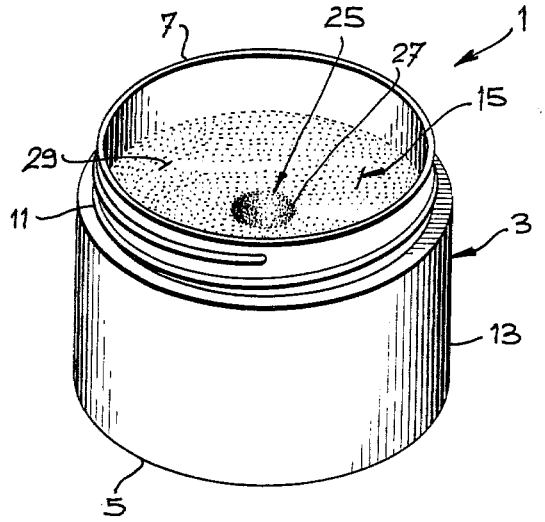
FIG. 1 is a perspective view of an embodiment of the device for treating fingernails with a liquid according to the invention, with the cover of the device removed.
Figure 2:
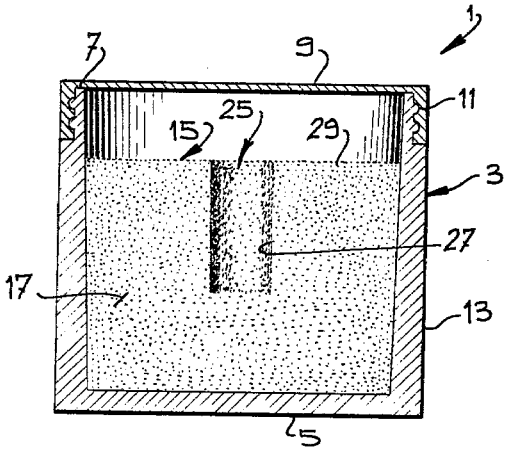
FIG. 2 is a cross-section view of the device shown in FIG. 1.
Figure 3:
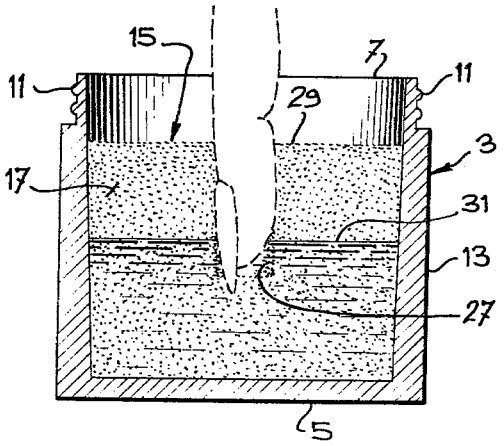
FIG. 3 is a cross-section view of the device shown in FIG. 1 and 2 in use.

The device 1 shown in FIGS. 1 to 3 includes a container 3. The container 3 has a squat, cylindrical shape with a side wall 13, a closed, flat bottom 5 and an open top 7. The top 7 of the container is normally closed by a cover 9 which screws onto threads 11 formed on the outer surface of the sidewall 13 of the container. The container 3 is sized to fit comfortably in the hand of a person and has a diameter of about two and one half inches.

A liquid absorbing member 15 is provided within the container. The liquid absorbing member 15 consists of a cylindrical sponge pad 17 sized to fit snugly within the container 3. The pad 17 has an outer diameter slightly larger than the inner diameter of the container sidewall 13 so that it is frictionally held within the container by sidewall 13. The pad 17 has also a height somewhat less than the height of the container 3 and is positioned within the container 3 close to, or adjacent, the bottom 5 of the container.

The pad 17 has means 25 for receiving a finger the nail of which is to be treated. The receiving means 25 consists of a blind cylindrical hole 27 extending partway through the pad 17 from the top end 29 of the pad. The hole 27 is located in the center of the pad 17 and is sized to snugly receive the end of a single finger.

In use, as shown in FIG. 3, the container 3 is opened, and treatment liquid, such as a nail polish remover, is poured into the container, to be absorbed by the sponge pad 17, to a level 31 just below the top 29 of the sponge. Each finger, in turn, is then inserted into hole 27 and rotated therein to have the liquid remover act on the nail polish and at the same time to have the inner sponge surface of hole 27 frictionally loosen the nail polish as it softens to help in removing it.

The sponge pad 17 can be easily replaced, or removed for cleaning and for replacing the used treatment liquid. The relatively large diameter container 3, large at least in comparison to the diameter of the finger hole 27, provides a large friction area between wall 13 and pad 17 to prevent rotation of the pad while rotating or oscillating a finger in the hole 27. The relatively large, flat-bottomed container also provides for a solid base to minimize tipping of the container when it is placed down, and thus avoid spilling the liquid remover. Maintaining the liquid level 31 below the top 29 of the sponge pad 17 allows the container 3 to be relatively freely manipulated during use without having to worry too much about spilling liquid remover. Some liquid could collect in the bottom of blind hole 27 but not a great deal.

The blind hole 27, forming the finger receiving means 25, can be extended through the pad 17 if desired. However this would permit more liquid to collect in the hole and would also provide access to any liquid pool that collects beneath pad 17, if the pad 17 was not pushed right down against container bottom 5. For this reason, the use of blind hole 27 is preferred.

Figure 4:
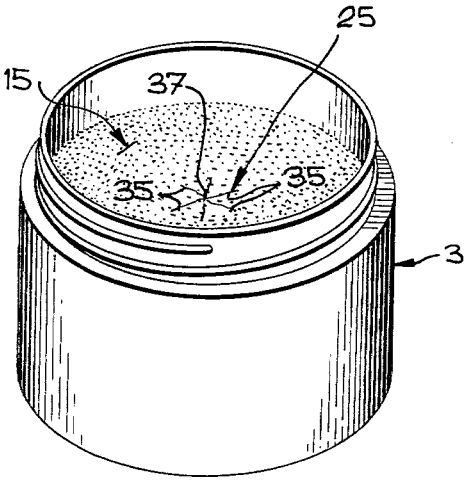
FIG. 4 is a perspective view of another embodiment of the device according to the invention.

In another embodiment as shown in FIG. 4, the finger receiving means 25 comprise a series of slits 35 cut part-way into the sponge from its top end and arranged in a star shaped pattern. The finger is pushed into the sponge at the center 37 of the slits 35, the sponge giving way to the slits 35 to receive the finger.

I claim:

1. A device for use in treating fingernails with liquid, said device comprising:
   - a flat-bottom container with a height, said container having a removable cover;
   - a liquid, disposed in said container, for treating said fingernails;
   - a sponge pad fitted into said container with a friction fit, said sponge pad comprising a means for preventing sloshing of said liquid in said container by virture of covering the entire diameter of said container; and
   - means, in said sponge pad, for snugly receiving at least said fingernail to be treated, said receiving means extending only partially into said sponge pad.

2. A device as claimed in claim 1 wherein the fingernail receiving means consists of a blind hole extending down from the top end of the sponge pad.

3. A device as claimed in claim 1 wherein the fingernail receiving means consists of a series of slits formed part way into the sponge pad from its top end, said slits being arranged in a star-shaped pattern.

4. A device as claimed in claim 1, wherein the sponge pad has a height less than the height of the container.

5. A device as claimed in claim 4 wherein the container and the pad are cylindrical in shape, the pad having an outer diameter slightly larger than the inner diameter of the container to obtain said friction fit.

6. A method of treating fingernails comprising:
   - (a) providing a flat-bottomed container with a removable cover,
   - (b) placing and frictionally holding a liquid absorbing sponge pad within said container,
   - (c) providing said sponge pad with a generally centrally located small finger receiving means,
   - (d) at least partially filling the container with fingernail treating liquid,
   - (e) inserting at least the end of the finger in said finger receiving means wherein the finger receiving means snuggly and frictionally engages the finger to treat the nail thereon.

7. The method of claim 6 wherein said finger receiving means consists of forming a blind hole in the top of the sponge pad.

8. The method of claim 6 wherein said finger receiving means consist of providing a series of crossed slits in the top of the sponge pad.

* * * * *

REEXAMINATION CERTIFICATE (228th)

United States Patent [19]

Duceppe

[11] B1 4,282,891

[45] Certificate Issued Jul. 24, 1984

[54] FINGERNAIL TREATING DEVICE

[75] Inventor: Antoine Duceppe, Ville d'Anjou, Canada

[73] Assignee: Revelations Antoine Ltee, Ville d'Anjou, Canada

Reexamination Request:
No. 90/000,297, Nov. 26, 1982

Reexamination Certificate for:

| | |
|---|---|
| Patent No.: | **4,282,891** |
| Issued: | **Aug. 11, 1981** |
| Appl. No.: | **912,887** |
| Filed: | **Jun. 5, 1978** |

[51] Int. Cl.[3] ..... A45D 29/18
[52] U.S. Cl. ..... 132/73.5; 132/73
[58] Field of Search ..... 132/73.5, 73

[56] References Cited

U.S. PATENT DOCUMENTS

| | | | |
|---|---|---|---|
| 2,596,725 | 5/1952 | Robbins | 15/244 R |
| 2,961,682 | 11/1960 | Wurmböck et al. | 15/104.92 |
| 3,369,553 | 2/1968 | Keesee | 132/73.5 |

FOREIGN PATENT DOCUMENTS

| | | | |
|---|---|---|---|
| 49759 | 4/1982 | Fed. Rep. of Germany | 132/73 |

*Primary Examiner*—G. E. McNeill

[57] ABSTRACT

A device for use in treating fingernails with a liquid, such as a nail polish remover. The device comprises a flat-bottomed, cylindrical container having an open top normally closed by a cover. A cylindrical sponge is press-fitted into the container to be frictionally held in place. A finger hole is provided in the sponge. Treatment liquid is poured into the container to be absorbed by the sponge to a level where it can act on the end of a finger inserted into the hole. The finger fits snugly in the hole and is rotated or oscillated therein to assist the treatment.

REEXAMINATION CERTIFICATE ISSUED UNDER 35 U.S.C. 307.

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 1–8 is confirmed.

New claims 9–15 are added and determined to be patentable.

*9. A method of treating fingernails comprising:*

*(a) providing a flat-bottomed container with a removable cover,*

*(b) placing and frictionally holding a liquid absorbing sponge pad within said container,*

*(c) providing said sponge pad with a generally centrally located small finger receiving means, said small finger receiving means being provided by at least one slit in the sponge pad,*

*(d) at least partially filling the container with fingernail treating liquid, and*

*(e) inserting at least the end of the finger in said finger receiving means wherein the finger receiving means snugly and frictionally engages the finger to treat the nail thereon.*

*10. The method of claim 8, wherein said small finger receiving means is provided by a series of crossed slits in the sponge pad.*

*11. A method of treating fingernails comprising:*

*(a) providing a flat-bottomed, generally cylindrical container with a removable cover, the container having a sidewall,*

*(b) placing and frictionally holding a liquid absorbing, generally cylindrical sponge pad within said container, said placing and frictional holding step being accomplished, in part, by sizing the sponge pad so that it has, when in a relaxed condition, an outer diameter slightly larger than the inner diameter of the container sidewall, the cylindrical sponge pad being sized (i) so as to fit snugly within the container, and (ii) so as to be frictionally held within the container by the sidewall, and (iii) so as to cover substantially the entire diameter of the container,*

*(c) providing said sponge pad with a generally centrally located small finger receiving means which is sized to snugly receive the end of a single finger, said steps of (i) placing and frictionally holding the sponge pad and (ii) providing the sponge pad with a small finger receiving means being carried out by providing the container with a relatively large diameter at least in comparison with the size of the small finger receiving means to, in turn, provide a large friction area between the sidewall of the container and the sponge pad to thereby prevent rotation of the sponge pad while rotating or oscillating a finger in the finger receiving means,*

*(d) at least partially filling the container with fingernail treating liquid, and*

*(e) inserting at least the end of the finger in said finger receiving means wherein the finger receiving means snugly and frictionally engages the finger to treat the nail thereon.*

*12. The method of claim 11, wherein said small finger receiving means is provided by at least one slit in the sponge pad.*

*13. A method of treating fingernails comprising:*

*(a) providing a flat-bottomed container with a removable cover,*

*(b) placing and frictionally holding a liquid absorbing sponge pad within the container, the sponge pad having a top,*

*(c) providing said sponge pad with a generally centrally located small finger receiving means having upper and lower ends,*

*(d) at least partially filling the container with fingernail treating liquid to provide a reservoir of liquid within the container so that the level of liquid will be above the lower end of the finger receiving means and below the top of the sponge pad, whereby the majority of the liquid will be absorbed by the sponge and the liquid will be prevented from easily escaping the container even if the container is tipped during use and whereby a spill-proof container with a self-contained liquid reservoir is provided, and*

*(e) inserting at least the end of the finger in said finger receiving means wherein the finger receiving means snugly and frictionally engages the finger to treat the nail thereon.*

*14. A method of treating fingernails, comprising:*

*(a) providing a flat-bottomed, generally cylindrical container with a removable cover, the container having a sidewall,*

*(b) placing and frictionally holding a liquid absorbing, generally cylindrical sponge pad within the container, the sponge pad having a top, said placing and frictional holding step being accomplished, in part, by sizing the sponge pad so that it has, when in a relaxed condition, an outer diameter slightly larger than the inner diameter of the container sidewall, the cylindrical sponge pad being sized: (i) so as to fit snugly within the container, (ii) so as to be frictionally held within the container by the sidewall, and (iii) so as to cover substantially the entire diameter of the container,*

*(c) providing said sponge pad with a generally centrally located small finger receiving means which is sized to snugly receive the end of a single finger, said small finger receiving means being provided by at least one slit in the sponge pad and having upper and lower ends, said steps of (i) placing and frictionally holding the sponge pad and (ii) providing the sponge pad with a small finger receiving means being carried out by providing the container with a relatively large diameter at least in comparison with the size of the small finger receiving means to provide a large friction area between the sidewall of the container and the sponge pad to thereby prevent rotation of the sponge pad while rotating or oscillating a finger in the finger receiving means,*

*(d) at least partially filling the container with fingernail treating liquid to provide a reservoir of liquid within the container so that the level of liquid will be above the lower end of the finger receiving means and below the top of the sponge pad, whereby the majority of the liquid will be absorbed by the sponge and the liquid*

*will be prevented from easily escaping the container even if the container is tipped during use and whereby a spill-proof container with a self-contained liquid reservoir is provided, and*

*(e) inserting at least the end of the finger in said finger receiving means wherein the finger receiving means*

*snugly and frictionally engages the finger to treat the nail thereon.*

*15. The method of claim 14, wherein said small finger receiving means is provided by a series of crossed slits in the sponge pad.*

* * * * *